US008256358B2

(12) United States Patent
Looser

(10) Patent No.: US 8,256,358 B2
(45) Date of Patent: Sep. 4, 2012

(54) PIECE OF FURNITURE

(75) Inventor: Hans Looser, Wangen (DE)

(73) Assignee: Moll Funktionsboebel GmbH, Gruibingen (DE)

( * ) Notice: Subject to any disclaimer, the term of this patent is extended or adjusted under 35 U.S.C. 154(b) by 259 days.

(21) Appl. No.: 12/733,542

(22) PCT Filed: Aug. 19, 2008

(86) PCT No.: PCT/EP2008/006800

§ 371 (c)(1),
(2), (4) Date: Mar. 5, 2010

(87) PCT Pub. No.: WO2009/036855

PCT Pub. Date: Mar. 26, 2009

(65) Prior Publication Data

US 2010/0175592 A1 Jul. 15, 2010

(30) Foreign Application Priority Data

Sep. 13, 2007 (DE) ..... 10 2007 043 789

(51) Int. Cl.
*A47B 9/00* (2006.01)

(52) U.S. Cl. ..... 108/147; 248/188.2

(58) Field of Classification Search ..... 108/147, 108/10, 4, 144.11, 7; 248/188, 188.6, 188.1, 248/188.2, 188.4, 188.5
See application file for complete search history.

(56) References Cited

U.S. PATENT DOCUMENTS 444,663 A * 1/1891 Colliier ..... 108/7
610,933 A * 9/1898 Wagoner ..... 187/235
1,471,928 A * 10/1923 Smith ..... 108/147
1,597,631 A * 8/1926 Spindel ..... 108/147
1,943,280 A * 1/1934 Arnold ..... 108/147
2,499,005 A * 2/1950 Sellers ..... 108/147
2,694,612 A * 11/1954 Morrow ..... 108/147
2,713,520 A * 7/1955 Greene ..... 108/147
3,415,586 A * 12/1968 Hammond ..... 108/147

(Continued)

FOREIGN PATENT DOCUMENTS

DE 89 13 417.6 U1 5/1990

(Continued)

OTHER PUBLICATIONS

German Patent Office Search Report dated Jan. 28, 2008 (2 pages).

(Continued)

*Primary Examiner* — Jose V Chen

(74) *Attorney, Agent, or Firm* — Flynn, Thiel, Boutell & Tanis, P.C.

(57) ABSTRACT

The invention relates to a piece of furniture containing a furniture base part (13*a*-13*f*), in particular a furniture frame, and a furniture part (11) movable relative thereto, in particular a table top (12), with an adjusting gear (20*a*-20*f*) for driving the furniture part (11) and with an actuating mechanism (30*a*-30*f*) for the rotary actuation of a drive shaft (36*a*-36*f*) of the adjusting gear (20*a*-20*f*). In the piece of furniture (10*a*-10*f*), it is provided that the actuating mechanism (30*a*-30*f*) for the rotary actuation of the adjusting gear (20*a*-20*f*) contains a manually operated cable- or belt-type pulling element (31*a*-31*f*) which is wrapped around a wrapping section (51*a*-51*f*) coupled for rotation with the drive shaft (36*a*-36*f*) at least during an actuation of the actuating mechanism (30*a*-30*f*) and which, when pulled, causes the drive shaft (36*a*-36*f*) to rotate.

24 Claims, 6 Drawing Sheets

U.S. PATENT DOCUMENTS

| | | | | |
|---|---|---|---|---|
| 4,751,884 | A * | 6/1988 | Ball | 108/147 |
| 5,400,721 | A * | 3/1995 | Greene | 108/147 |
| 5,408,940 | A * | 4/1995 | Winchell | 108/147 |
| 5,549,053 | A * | 8/1996 | Grout | 108/147 |
| 5,598,789 | A * | 2/1997 | Jonker | 108/147 |
| 5,682,825 | A * | 11/1997 | Manner | 108/147 |
| 5,715,759 | A * | 2/1998 | Lee | 108/20 |
| 6,152,049 | A * | 11/2000 | Schmidt | 108/147 |
| 6,289,825 | B1 | 9/2001 | Long | |
| 6,412,427 | B1 * | 7/2002 | Merkt | 108/147 |
| 7,128,003 | B2 * | 10/2006 | Okninski | 108/147 |
| 7,412,931 | B2 * | 8/2008 | Seidl et al. | 108/147 |
| 7,743,716 | B1 * | 6/2010 | Burka | 108/147 |
| 7,908,981 | B2 * | 3/2011 | Agee | 108/147 |

FOREIGN PATENT DOCUMENTS

| | | |
|---|---|---|
| DE | 198 56 864 A1 | 6/2000 |

OTHER PUBLICATIONS

International Search Report dated Nov. 21, 2008 (3 pages).

* cited by examiner

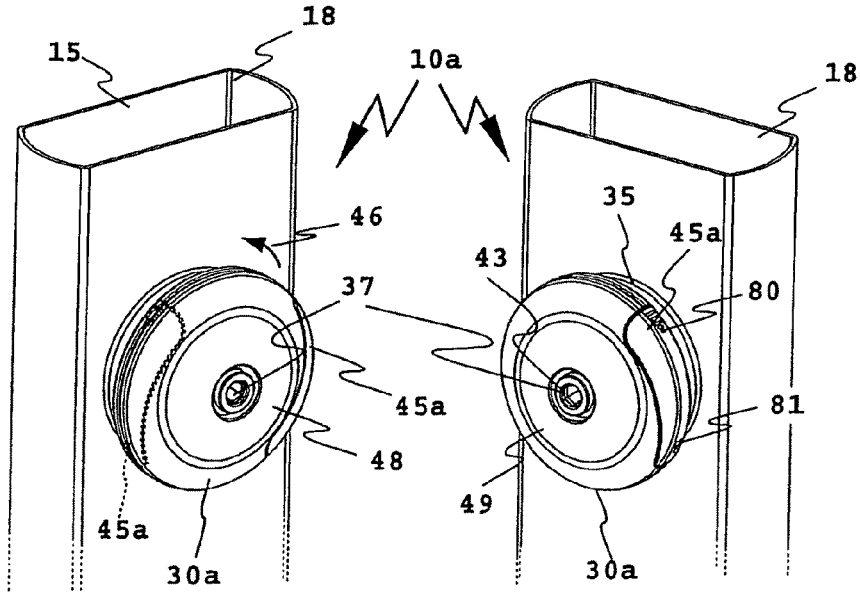
Fig.4a
Fig.4b
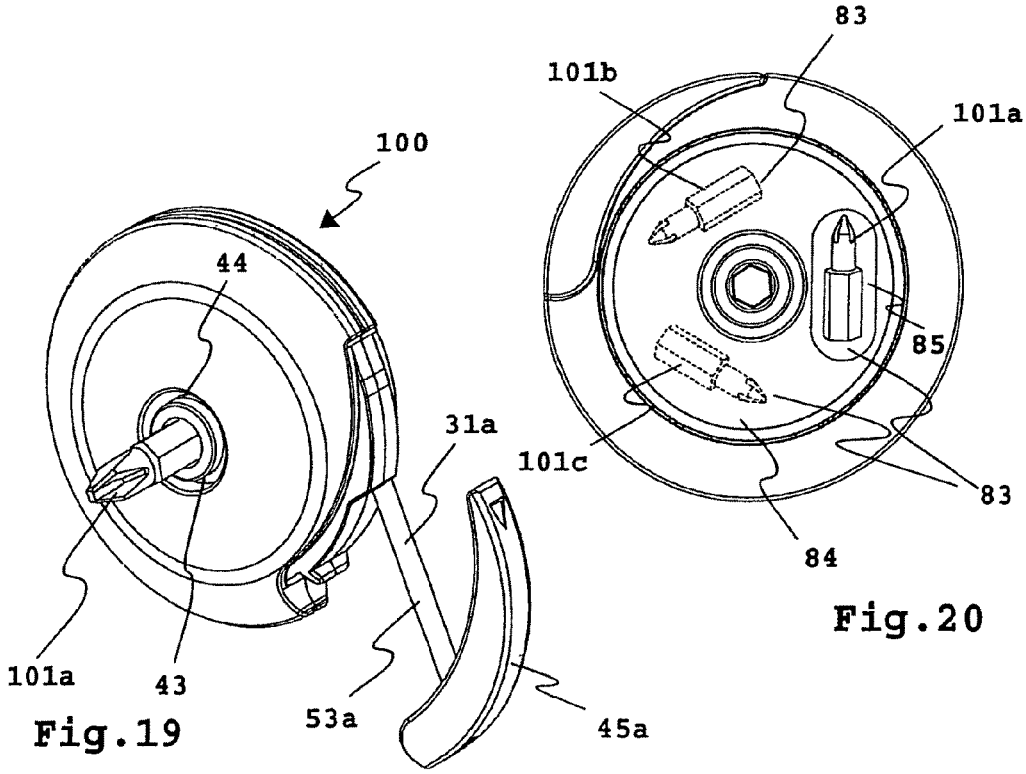
Fig.20
Fig.19

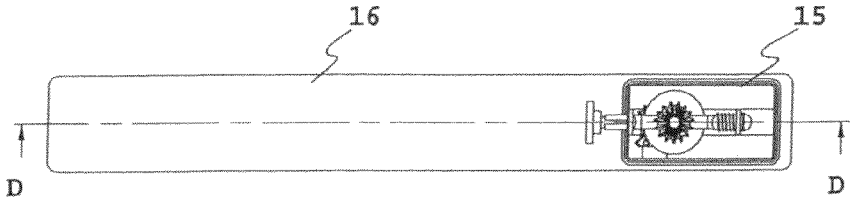
Fig.5
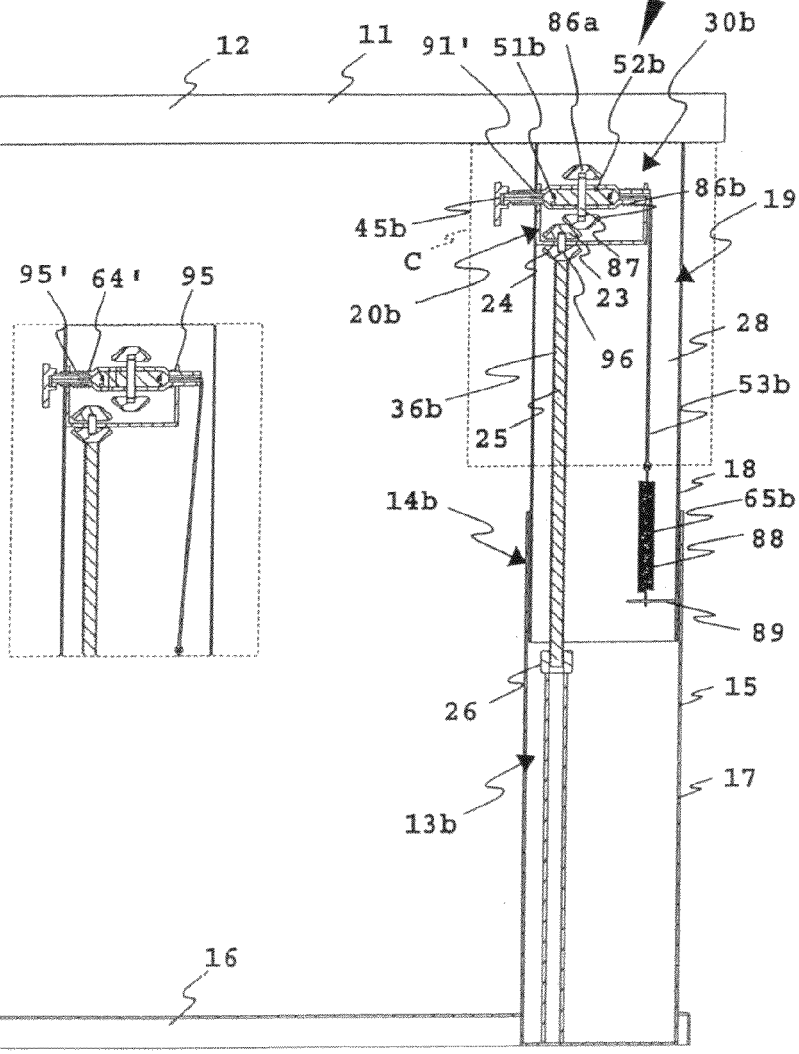
Fig.6b
Fig.6a

PIECE OF FURNITURE

The invention relates to a piece of furniture comprising a furniture base part, in particular a furniture frame, and a furniture part movable relative thereto, in particular a table top, with an adjusting gear for driving the furniture part and with an actuating mechanism for the rotary actuation of a drive shaft of the adjusting gear.

The piece of furniture may for example be a desk and/or a high desk with a table top capable of tilting or vertical adjustment. Such pieces of furniture are usually fitted with toothed gearing operated using a crank. As an alternative, the movable furniture parts, such as table tops, are vertically adjustable or tiltable by means of a motor.

The motorised solution is relatively expensive. The manual operation of a crank is awkward.

The invention is therefore based on the problem of providing a simple but comfortable actuation of an adjusting gear in a piece of furniture of the type referred to above.

To solve this problem, it is provided in a piece of furniture of the type referred to above that the actuating mechanism for the rotary actuation of the adjusting gear comprises a manually operated cable- or belt-type pulling element which is wrapped around a wrapping section coupled for rotation with the drive shaft at least during an actuation of the actuating mechanism and which, when pulled, causes the drive shaft to rotate.

The cable- or belt-type pulling element may for example be a pull cable or belt. Although sections of the pulling element may be toothed, a simple belt or a simple cable is preferred. The term cable- or belt-type also covers a pulling tape.

The adjusting gear is expediently self-locking, so that the movable furniture part remains in its position. The adjusting gear may obviously comprise coupled gear components, for instance gear components accommodated in two or more legs or columns of the furniture base part.

The wrapping section may be provided directly on the drive shaft of the adjusting gear. As a result, the pulling element is wrapped around the adjusting gear. In an alternative embodiment, the wrapping section is provided on a drive reel which may be fitted to the drive shaft. Between the drive reel and the drive shaft, further gearing elements such as gears may obviously be provided.

For the rotary coupling with the adjusting gear, various variants are proposed for the drive reel:

It may for example have a toothing engaging a similar toothing on the drive reel. The drive reel may further be coupled for rotation with a gear which may for example be provided on the same shaft. The drive reel may further be provided with a protruding rotating shaft or a location for the drive shaft of the adjusting gear.

The rotating shaft on the drive reel is advantageously axially displaceable along its axis, so that, for rotary coupling with the adjusting gear for rotation in opposite directions, it can protrude from opposite end faces of the drive reel. The rotating shaft preferably locks in these two positions. It is, however, possible to provide toothing or a gear on both sides of the drive reel, allowing the drive reel to be reversed in order to act on the adjusting gear in different directions.

The actuating mechanism is advantageously provided with a return spring or other return spring means which can be tensioned into a pull-out position as the pulling element is pulled and which returns the pulling element to its neutral position. In this context, it is possible to operate the pulling element already in the pulling-out process in the pull-out position. On the other hand, the pull-out position may be a position which precedes the operating action, making the pulling element available for the actuation of the adjusting gear in the pull-out position.

In this variant, in particular, it is advantageous if the pulling element is provided with a sling which the operator can grip and which is provided in the pull-out position for operation in the manner of a looping or loop movement.

The return spring means act on the pulling element for example substantially at right angles to the pulling direction of the pulling element. In this way, the return spring means pull the pulling elements behind the furniture contour in a manner of speaking. For operation, the pulling element is pulled in front of the piece of furniture to make it available in its pull-out position, for example for the loop movement referred to above.

In its neutral position, the pulling element is expediently retracted into a neutral position space. This may for example be an interior space or cavity of the piece of furniture.

The neutral position space may, however, be provided at the actuating mechanism itself.

The return means are for example designed for winding the pulling element onto the wrapping section or onto a separate take-up reel. As described above, the wrapping section may be provided directly on the drive shaft or on the drive reel.

The adjusting gear or the actuating mechanism is advantageously provided with a free-wheel device. The free-wheel device uncouples the pulling element while it is being returned into its neutral position, enabling it to be returned into its neutral position while free-wheeling. The free-wheel device cancels the coupling of the pulling element for rotation with the drive shaft while it is returned into its neutral position.

The coupling between the actuating mechanism and the adjusting gear is advantageously releasable. In this way, the actuating mechanism can for example be removed from the piece of furniture or connected to the adjusting gear with a different direction of rotation.

A spring arrangement holding the actuating mechanism in a position coupled to the adjusting gear is advantageously provided.

The actuating mechanism can expediently be connected to the adjusting gear in a first and a second drive position, acting in opposite directions on the adjusting gear in the two drive positions. For this purpose, it is for example possible to mount the actuating mechanism on the piece of furniture in a way to allow it to move, for example rotate, between the first and second drive positions. An advantageous design provides that the drive reel comprising the wrapping section is rotatably mounted on a rotary holder. The rotary holder is rotatably mounted on a rotary mount between the two drive positions for coupling for rotation in opposite directions. The rotary mount comprises a tubular part serving as a bearing element, through which the pulling element is guided to the drive reel. It is obviously possible to provide two tubular parts with this variant for guiding the pulling element on its way towards and away from the drive reel. Between the two tubular parts, retaining arms encompassing the drive reel in the manner of a fork or other retaining structures are provided.

As an alternative, the actuating mechanism may be removable from the piece of furniture. It may for example be pushed or screwed onto the adjusting gear. A different mounting arrangement on the piece of furniture onto which the actuating mechanism can be pushed for coupling to the adjusting gear is also feasible.

A holder for releasably connecting the actuating mechanism expediently allows for a rotary movement on the actuating mechanism. This can rotate with the pulling element when the latter is operated, until the pulling element is withdrawn from a pull-out opening of the actuating mechanism. Advantageously, however, a frictional or clamping action is provided between the holder and the actuating mechanism, so that the rotary movement is not uncontrolled.

The adjusting gear advantageously converts a rotary input movement into a linear movement. In particular with tiltable furniture, however, the adjusting gear may convert the rotary movement into a movement of the furniture part along a curved path of motion.

Instead of connecting the actuating mechanism to the adjusting gear for rotation in different directions, the actuating mechanism may be provided with two pulling elements which act on the adjusting gear in different directions. Each pulling element can expediently be caused to free-wheel by means of a free-wheel device while the other pulling element is operated.

For visual appearance, the pulling element preferably does not project from an external contour of the piece of furniture in its neutral position, but can be pulled out in front. The piece of furniture or the actuating mechanism may be fitted with an idler pulley arrangement for controlling the pulling movement of the pulling element.

The furniture part can be vertically adjusted or tilted with the adjusting gear.

The invention is in particular preferred in office furniture and furniture for children and youngsters, as it can be adjusted to a comfortable, ergonomically favourable working position by means of the actuating mechanism according to the invention.

Embodiments of the invention are explained below with reference to the drawing. Of the drawing.

Figure 1:
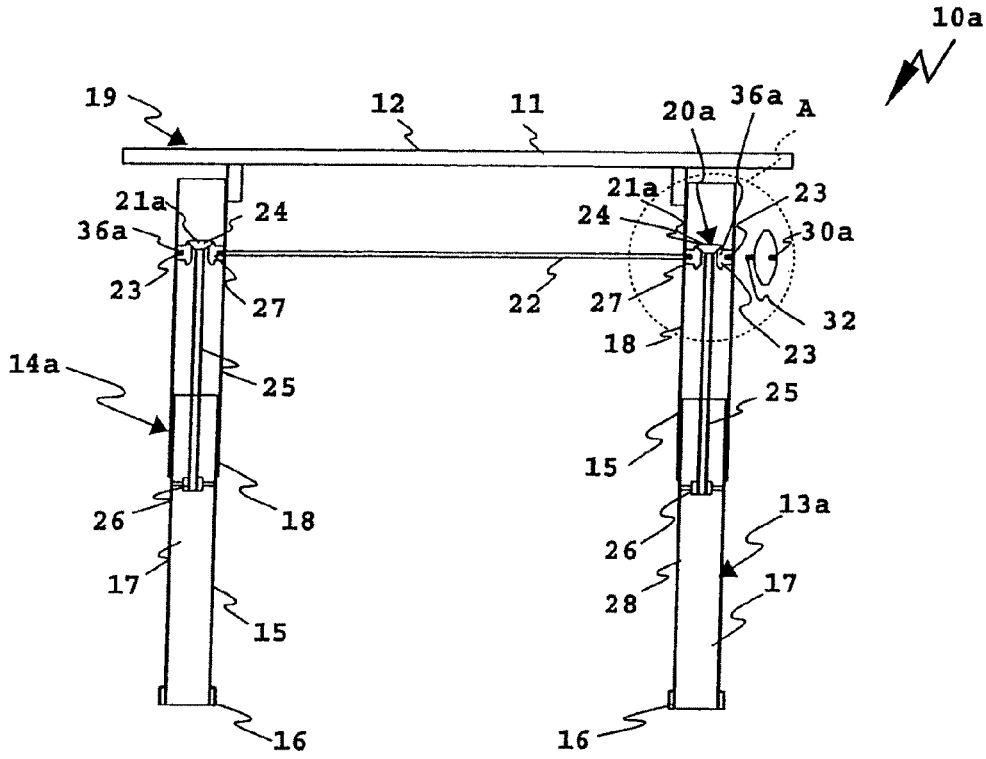
FIG. 1 is a diagrammatic partial cutaway front view of a desk from the rear.
Figure 2:
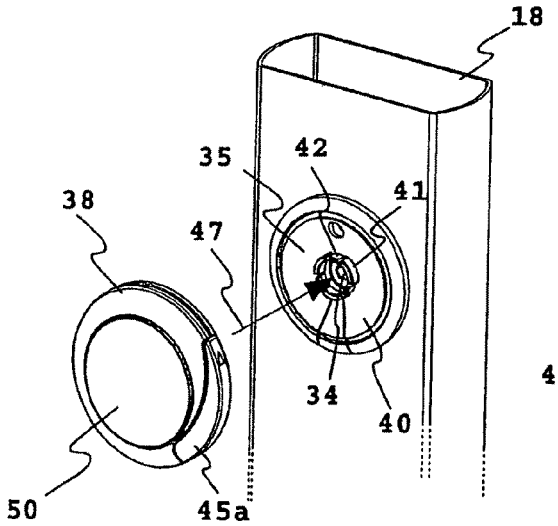
FIG. 2 is an oblique part-view of the piece of furniture according to FIG. 1, approximately corresponding to a section A of an actuating mechanism which is still removed from the piece of furniture.
Figure 3:
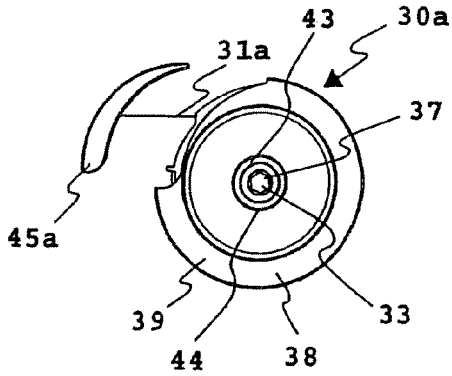
FIG. 3 is a side view of the actuating mechanism.

FIG. 4*a* is the part-view from FIG. 1 with the actuating mechanism mounted on the piece of furniture for a first direction of rotation;

FIG. 4*b* is a view corresponding to FIG. 4*a*, but with the actuating mechanism mounted for an opposing direction of rotation;

FIG. 5 is a partial top view of a second embodiment of a piece of furniture with a fixed cable-controlled actuating mechanism, a furniture leg being visible;

FIG. 6*a* is a lateral section of the piece of furniture according to FIG. 5, approximately along a line D-D in FIG. 5;

FIG. 6*b* is a part-view of a section C of the piece of furniture according to FIG. 6*a;*

Figure 7:
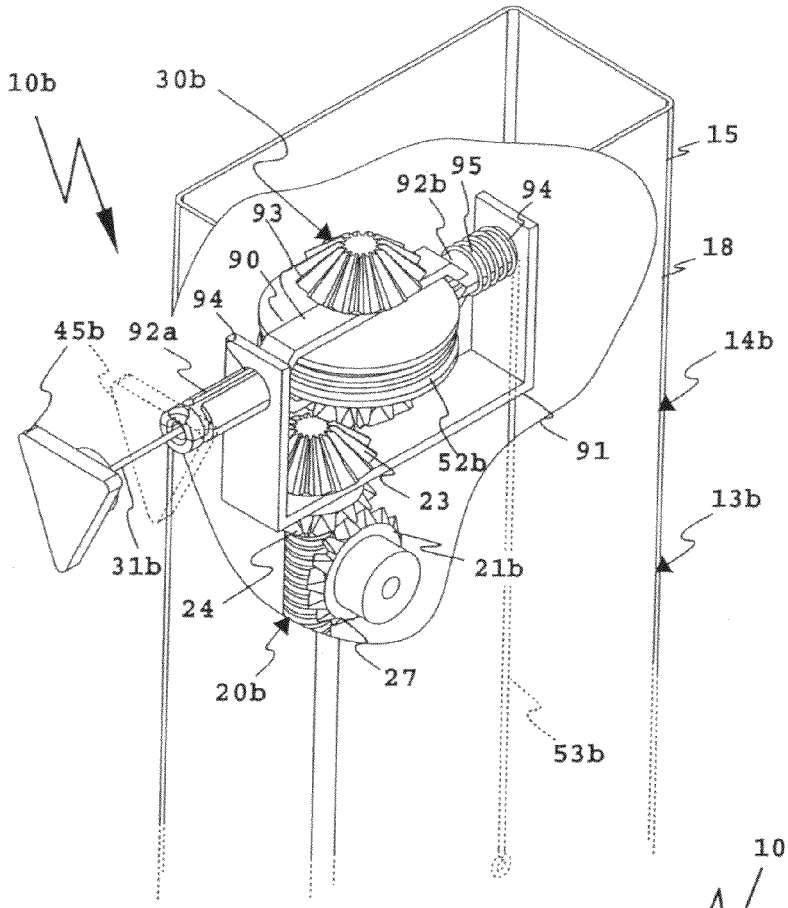
Figure 8:
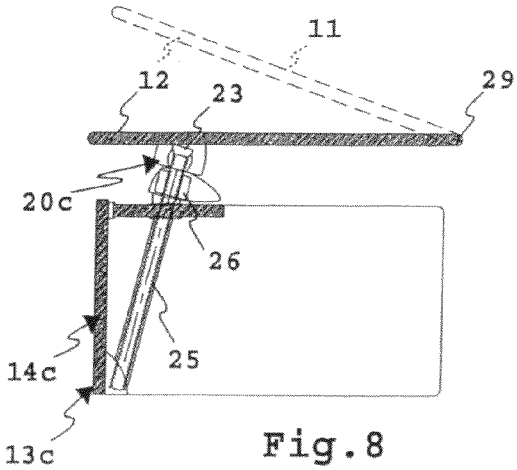
Figure 9:
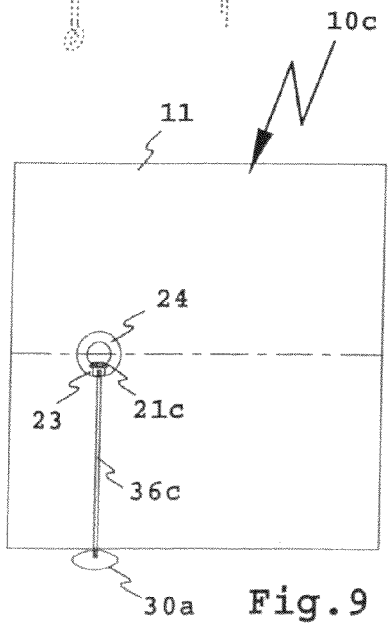
Figure 10:
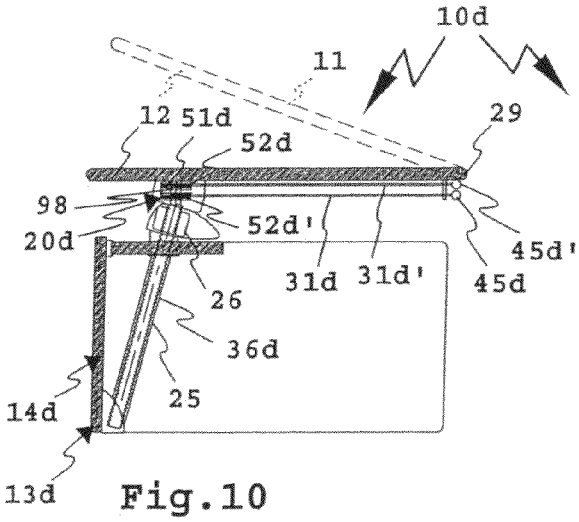
Figure 11:
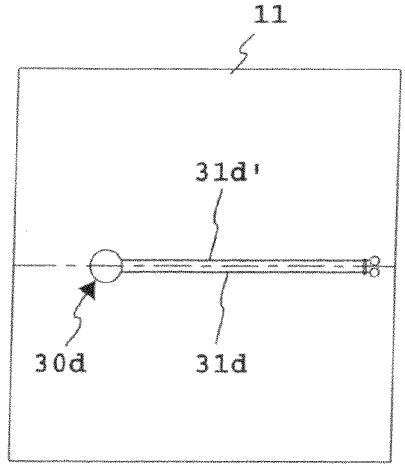
Figure 12:
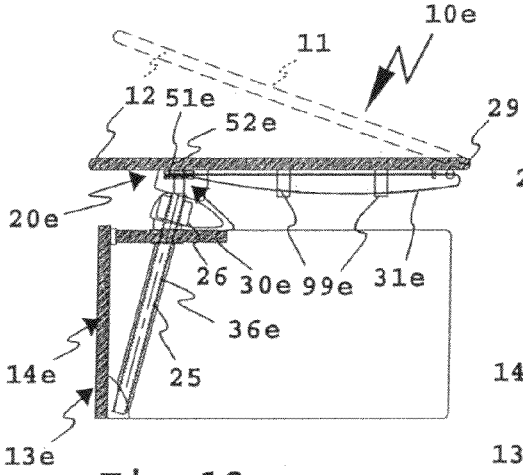
Figure 14:
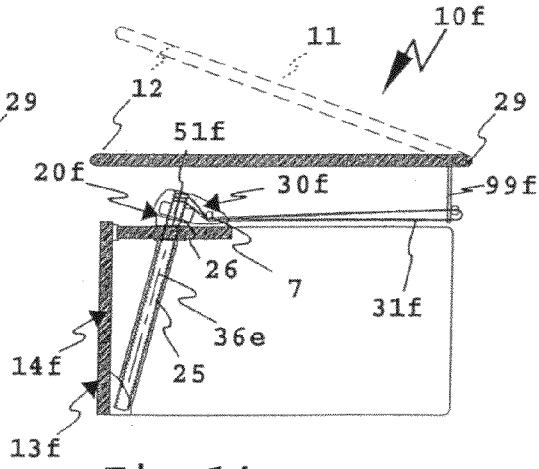
Figure 13:
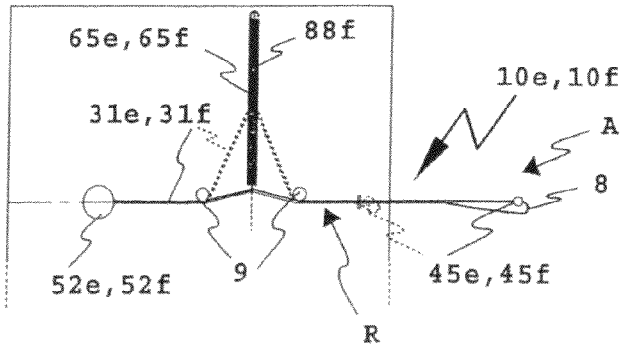
Figure 15:
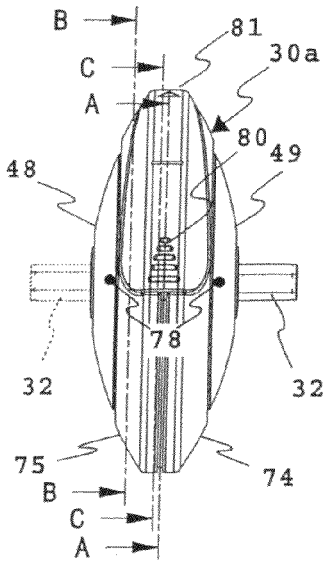
Figure 16:
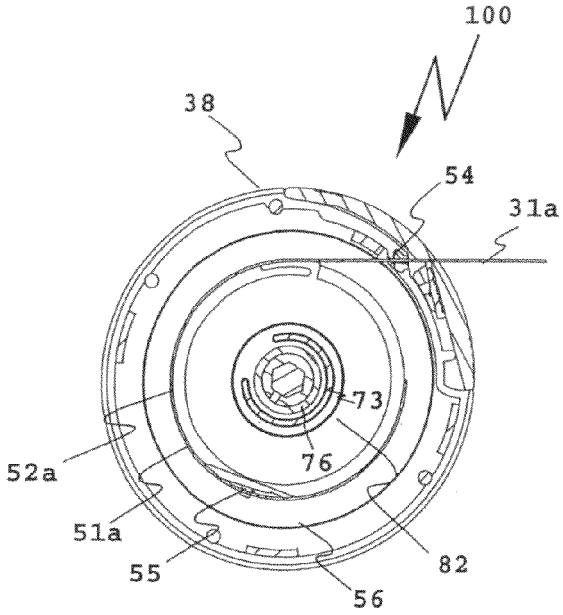
Figure 17:
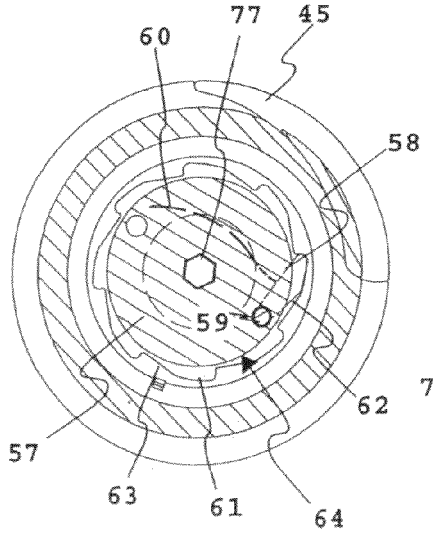
Figure 18:
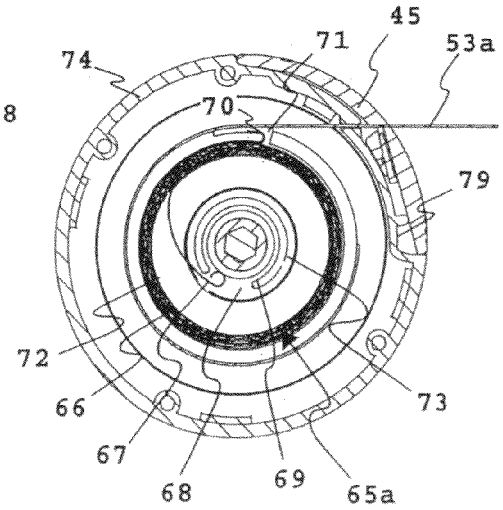

FIG. 7 is a partial oblique view of the piece of furniture according to FIG. 6, approximately corresponding to the section C;

FIG. 8 is a side view of a third embodiment of a piece of furniture according to the invention, with a tiltable table top and an actuating mechanism approximately corresponding to the piece of furniture according to FIGS. 1 to 4;

FIG. 9 is a top view of the piece of furniture according to FIG. 8;

FIG. 10 is a side view of a fourth embodiment of a piece of furniture according to the invention with two cable controls;

FIG. 11 shows the piece of furniture according to FIG. 10 from above;

FIG. 12 is a side view of a fifth embodiment of a piece of furniture according to the invention with a tiltable table top;

FIG. 13 shows the piece of furniture according to FIG. 12 from above;

FIG. 14 is a side view of a piece of furniture with a tiltable top, the pulling element being wrapped directly around a drive shaft of the adjusting gear;

FIG. 15 is a side view of the actuating mechanism according to FIG. 1;

FIG. 16 is a section of the actuating mechanism according to FIG. 15 along a line A-A;

FIG. 17 is a section of the actuating mechanism according to FIG. 15 along a line B-B;

FIG. 18 is a section of the actuating mechanism according to FIG. 15 along a line C-C;

FIG. 19 is a perspective view of the actuating mechanism according to FIGS. 15-18 for use as a hand tool with a screwdriver insert; and FIG. 20 is a top view of the hand tool according to FIG. 19.

Identical or similar components of the embodiments described below are identified by the same reference numbers.

In a piece of furniture 10*a* shown in FIG. 1, a furniture part 11, for example a table top 12, is movably mounted on a furniture base part 13*a*. The furniture base part 13*a* includes at least a lower part of a furniture frame 14*a* to the top of which the table top 12 is attached. Telescoping columns 15 of the furniture frame 14*a* stand on feet 16 with a horizontally oblong shape. While the lower column parts 17 are permanently joined to the feet 16, the upper column parts 18 are displaceable relative to the lower column parts 17, allowing the vertical adjustment of the furniture part 11 held by the upper column parts 18 by displacing the upper column parts 18. The lower and upper column parts 17 and 18 are inserted into one another. Between the two columns, cross ties can be provided to stabilise the furniture frame.

An adjusting gear 20*a* is used for the vertical adjustment of an upper part 19 of the piece of furniture 10*a*, which includes the upper column parts 18 of the movable furniture part 11. To each movable column 15 there is assigned a sub-gear 21*a* for the vertical adjustment of the respective column 15. The sub-gears 21*a* are coupled for rotation by means of a coupling shaft 22. Drive gears 23 of the sub-gears 21*a* drive a driven gear 24 non-rotationally connected to a spindle 25. The gears 23, 24 and the spindle 25 are rotatably mounted on the upper column parts 18, and the spindle nut 26 is non-rotatably seated in the respective lower column part 17, so that the upper column parts 18 and thus the furniture upper part 19 can be vertically adjusted by rotating the spindle 25. Coupling gears 27 which are non-rotatably connected to the coupling shaft 22 and are for example mounted at its ends also engage the driven gear 24, this providing a rotary coupling between the sub-gears 21*a*. The sub-gears 21*a* and the vertical spindles 25 are accommodated in interiors 28 of the columns 15.

In principle, it would be possible to operate the adjusting gear 20*a* for example by means of a crank or another rotary handle. The invention however provides another solution:

Cable operation is provided for the rotary actuation of the adjusting gear 20*a*. An actuating mechanism 30*a* can be coupled to the adjusting gear 20*a* for its rotary actuation. A coupling piece 32, for example a polygonal shaft section held by a holder 33 of the actuating mechanism 30*a* suitable for use as a tool holder, establishes a rotary connection to a drive housing 34 in a holder 35 of the piece of furniture 10*a*. The holder 35 and the drive housing 34 may for example be polygonal, e.g. hexagonal. The drive housing 34 is provided on the drive gear 23. The drive gear 23 is for example mounted on a drive shaft 36*a* of the adjusting gear 20*a* or includes the drive shaft 36*a*. As the pulling element 31*a* is pulled, the holder 33 is made to rotate, and the rotation is transmitted to the drive shaft 36*a* via the coupling piece 32. The rotary motion of the drive shaft 36*a* is transmitted to the two spindles 25 via the driven gear 24 and the coupling provided by the coupling gears 27 and the coupling shaft 22, causing a vertical adjustment of the furniture upper part 19.

The holder 33 may be used as a tool holder, in which case the actuating mechanism 30*a* can be used as a hand tool 100, for example for assembling the piece of furniture 10*a*. In place of the coupling piece 32, a drilling or screwing tool 101*a*, 101*b* or 101*c* can then be inserted into a socket 37 of the holder which is suitable for use as a tool socket.

A housing 38 of the actuating mechanism 30*a* or the hand tool 100 then forms a handle section 39 which can be gripped comfortably. The circular-elliptical flat design of the housing 38 contributes to this facility.

One of the holders 35 is provided on each of the two upper column parts 18 on the outside of the piece of furniture 10. The holders 35 include retaining locations 40 such as plastic mouldings, which are located on the outside in the upper end region of the upper column parts 18. The actuating mechanisms 30*a* are installed into the retaining locations 40, locking means 41 of the holders engaging locking means 43 of the actuating mechanism 30*a*. The locking means 41 may for example be annular segmented locking projections 42 engaging a circular ring-shaped locking recess 44 on the housing 38 in the region of the tool socket 37. The segmentation of the locking projections 42 permits a resilient engagement and locking of the locking means 41 with the locking means 43. The circular ring-shaped design of the locking projections 42 and the locking recess 44 enables the actuating mechanism 30*a* to be rotated relative to the holder 35, so that, as the pulling element 31*a* is pulled on a handle part 45*a*, the housing 38 is rotated in the pulling direction of the pulling element 31*a*, for example in the direction of an arrow 46. The handle part 45*a* then is no longer in the position indicated by continuous lines, but in the rotary position indicated by broken lines.

FIGS. 4*a* and 4*b* further show that the actuating mechanism 30*a*, after being attached to the piece of furniture 10*a* along an arrow 47 (FIG. 2), is visually perceived to be an integral component of the piece of furniture 10*a*. The housing 38 is at least partially accommodated by the shell-type retaining location 40, so that the actuating mechanism 30*a* projects only to a very minor extent from the respective column 15.

The pulling element 31*a* can be pulled from the housing 38, for example in a forward direction towards a front side of the table top 12. If the actuating mechanism 30*a* is flanged to the adjusting gear 20*a*, for example in the position shown in FIG. 4*a*, the table top 12 is adjusted upwards. In the opposite direction, to adjust the furniture part 11 downwards, the actuating mechanism 30*a* is attached, for example pushed onto, to the holder 35 in the reversed position shown in FIG. 4*b*. For this purpose, sockets 37 for the coupling piece 32 and corresponding locking means 43 are provided at the two end faces 48 and 49.

It would further be possible to flange the actuating mechanism 30*a* to both transverse sides of the piece of furniture 10*a*, because both columns 15 for the sub-gears 21*a* are provided with holders 35 for the actuating mechanism 30*a*. In principle, this makes it possible to flange the actuating mechanism 30*a* optionally to the right- or left-hand side of one of the sub-gears 21*a* for actuating the adjusting gear 20*a* in different directions of rotation. In this case, the sockets 37 provided at the two end faces 48 and 49 for the coupling piece 32 could be omitted. The end face 48 of the housing 38 may for example be provided with a cover 50.

As an alternative, an axle piece could be permanently joined to the piece of furniture 10*a* or the actuating mechanism 30*a* in place of the replaceable coupling piece 32 and project in front of the respective component 10*a*, 30*a*.

The pulling element 31*a* is represented by a pulling tape 53*a* wrapped around a drive reel 52*a*. The pulling tape 53*a* causes a rotary actuation of the drive reel 52*a* when it is pulled out through an opening 54 of the housing 38. The pulling tape 53*a* is permanently attached to the drive reel 52*a*, for example by means of a clamp 55. For the lateral guidance of the pulling element 31*a*, the drive reel 52*a* is provided with radially projecting annular walls 56.

The drive reel 52*a*, which is rotatably mounted relative to the housing 38, drives a driven part 57 which comprises the tool holder 33 and is likewise rotatably installed into the housing 38 by way of coupling means comprising a coupling catch 58. The coupling catch 58 is pivotably mounted on the driven part 57, for example by means of a pivot bearing 59. Spring means, for example a spring arm 60 projecting in front of the coupling catch 58, load the coupling catch 58 towards a toothing 61 of the drive reel 52*a*, for example radially outwards, causing the coupling catch 58 to engage with the toothing 61. The toothing 61 is located on an inner circumference of the drive reel 52*a*. When the pulling element 31*a* is pulled from the actuating mechanism 30*a* or the hand tool 100, the coupling catch 58 hooks into the toothing 61, causing the drive reel 52*a* to drive the driven part 57. Now an end region of the coupling catch 58 bears against the steep flanks of the toothing 61 as a result of the loading by the spring arm 60.

As the pulling tape 53*a* is wound onto the drive reel 52*a* on the other hand, the drive reel 52*a* is free-wheeling. An even or inclined sliding side 62 of the coupling catch 58 now slides along sliding surfaces of the toothing 61, which are flatly inclined, so that the coupling catch 58 together with the toothing 60 forms a free-wheel device 64. The free-wheel device 64 allows a rotary decoupling of the driven part 57 from the drive reel 52*a* while the pulling element 31*a* is returned into its neutral position in the housing 38.

For this return movement, return spring means 65*a* with a torsion spring 66 are provided. One end 67 of the torsion spring 66 is supported on the housing 38, for example by engaging a recess 68 in a bearing location 69 of the housing 38. The other end 70 of the torsion spring 66 engages a recess 71 of the driven part 57. The end 70 is preferably bent in the manner of a hook. The end 70 for example has a U-shape for hooking into the driven part 57 in the region of the recess 71. As the pulling element 31*a* is pulled away from the actuating mechanism 30*a*, the torsion spring 66 is tensioned, while the diameter of at least some of the windings of the spring assembly 72 is reduced and the spring is at least partially supported on the outer circumference of an annular wall 73 of the housing 38 in the maximum pull-out position.

The annular wall 73 is provided on a housing part 74 of the housing 38 and includes the bearing location 69. The housing part 74 is closed by a further housing part 75 which also has an annular wall with a bearing location on the inside opposite the bearing location 69. This bearing location and the bearing location 69 support the driven part 57, the bearing ends 76 of which engage the two bearing locations. The bearing ends 76 are longitudinal end regions of the tubular tool holder 33, on the longitudinal ends of which the tool sockets 37 are formed.

The tool holder 33 has a through-passage 77 in which the coupling piece 32 is for example axially displaceable, so that it protrudes in front of either of the end faces 48 and 49. The coupling piece 32 and the screwing tools 101*a*-101*c* can be locked in the tool sockets 37 using locking means 78, for example locking balls.

The housing parts 74, 75 can expediently be locked together. On a radial outer circumference of the housing 38, a recess 79 for the handle part 45*a* is provided. An outer contour of the recess 79 matches an inner contour of the handle part 45*a*. For comfortable gripping, in particular for pulling out of the recess 79, the handle part 45*a* is expediently provided with a corrugation 80. An arrow marking 81 on the handle part 45*a* signals the adjusting direction (up or down) of the furniture part 11 and/or the direction of rotation of the tool holder 33 when the pulling element 31*a* is pulled out. The pulling tape 53*a* is attached to the handle part 45*a* between longitudinal ends of the handle part 45*a*, allowing the handle part 45*a* to be gripped with two fingers between which the pulling tape 53*a* runs.

The drive reel 52*a* is rotatably mounted on the driven part 57. A cylindrical outer circumference of the tool holder 33 for example passes through a bearing recess 82 of the drive reel 52*a*.

The housing 38 is expediently provided with bearing locations 83 for the accommodation of a drilling or screwing tool 101*a*-101*c*. The bearing locations 83 are used for driving these tools 101*a*-101*c*. The bearing locations 83 can be closed by a cover 84 with a removal opening 85. The removal opening 85 can be moved into the region of a respective bearing location 83. For this purpose, the cover 84 may for example be rotatable.

In a piece of furniture 10*b* according to FIGS. 7, 8, 9, the operating concept according to the invention is implemented with an actuating mechanism 30*b* fixed to the piece of furniture 10*b*. A furniture base part 13*b* substantially corresponds to the furniture base part 13*a*, with the difference that upper column parts 18 of columns 15 of the base part 13*b*, which forms a furniture frame 14*b*, are telescoping in the lower column parts 17.

To adjust the upper column parts 18 relative to the lower column parts 17, an adjusting gear 20*b* is provided of which only a sub-gear 21*b* is shown. In accordance with the concept of the adjusting gear 20*a*, this sub-gear 21*b* can act together with a corresponding sub-gear 21*b* in the other column 15 by means of a coupling shaft (not shown in the drawing). If this rotary coupling, only a coupling gear 27 engaging a driven gear of the adjusting gear 20*b* is shown. Like a drive gear 23 and the coupling gear 27, the driven gear 24 is a bevel gear. The driven gear 24 and the drive gear 23 are mounted on the upper end of a spindle 25 which is tightened into a spindle nut 26 on the lower column part 17 and is used for the vertical adjustment of a table top 12 of the piece of furniture 10*b*.

The adjusting gear 20*b* is operated by means of an actuating mechanism 30*b*. The actuating mechanism 30*b* comprises a pulling element 31*b* such as a cable 53*b* which is wrapped around a wrapping section 51*b* of a drive reel 52*b*. The pulling cable 53*b* is operated by means of a handle part 45*b* and can for example be extracted towards a front side of the table top 12. The pulling cable 53*b* is for example wrapped around the wrapping section 51*b* once or twice and, when pulled, causes the drive reel 52*b* to rotate. The drive reel 52*b* transmits its rotary motion by means of gears 86*a*, 86*b* non-rotatably connected to the drive reel 52*a*. The gears 86*a*, 86*b* are bevel gears. The gears 86*a*, 86*b* are mounted on the longitudinal ends of a shaft 87 passing through the drive reel 52*b*. The shaft 87 is non-rotatably connected to the drive reel 52*b* and the gears 86*a*, 86*b*. The gears 86*a*, 86*b* are used to operate the adjusting gear 20*b* in opposite directions of rotation.

Return spring means 65*b* are provided for returning the pulling cable 53*b* into an interior 28 of the column 15. These include a spring 88. One end of the spring 88 is connected to the pulling cable 53*b*, while the other end is permanently joined to the upper column part 18, being for example pivoted on a retaining projection 89. In contrast to the return spring means 65*a*, the return spring means 65*b* are not used for winding up the pulling element 31*b*, but only for tensioning against its pull-out direction.

The drive reel 52*b* is rotatably mounted on the furniture frame 14*b*. For this purpose, a rotary support 90 is provided for the rotatable mounting of the drive reel 52*a*. The rotary support 90 is in turn rotatably mounted on a rotary bearing holder 91 of the piece of furniture 10*b* for reversing the drive reel 52*b* between the two coupling positions, in each of which the gears 86*a*, 86*b* engage the drive gear 23. The rotary bearing holder 91 forms a part of a rotary mounting 91' for the rotary support 90. Tubular parts 92*a*, 92*b* between which retaining arms 93 encompassing the drive reel 52*a* in the manner of a fork extend are rotatably mounted in bearing locations 94 of the rotary bearing holder 91. The tubular parts 92 are axially displaceable in the bearing locations 94, so that the gears 86*a*, 86*b* can be brought into engagement with the drive gear 23 in a front position while being disengaged from the drive gear 23 in a rear position. A spring 95 holds the lower gear 86*a*, 86*b* in engagement with the drive gear 23. The rear tubular part 92*b* may for example pass through the spring 95, one end of which is supported on the rotary bearing holder 91 while the other end is supported on the two retaining arms 93.

The bearing locations 94 are for example located on legs of the U-shaped rotary bearing holder 91 which project upwards in front of a base part. A shaft 96 to which the gears 23, 24 are fitted is rotatably mounted on the base part between the two legs.

The rotary support 90 can be pushed away from the drive gear 23 against the force of the spring 95, which is illustrated in FIG. 8*a*, in order to cancel a rotary coupling between the actuating mechanism 30*b* and the adjusting gear 20*b*. It is then for example possible for the return spring means 65*b* to return the pulling cable 53*b* into the interior 28. It is further possible to reverse the rotary support 90 to bring the other gear 86*a* or 86*b* into engagement with the drive gear 23.

The pulling cable 53*b* is guided through the two tubular parts 92*a*, 92*b*.

The actuating mechanism 30*b* may be fitted with a free-wheel device 64'. The drive reel 52*b* may for example be spring-loaded against the pulling direction of the pulling element 31*b*. This is implemented in a variant shown in FIG. 8*a*, where the tubular part 92*a* passes through a spring 95'. One end of the spring 95' is supported on the rotary support 90, while the other end is supported on the rotary bearing holder 91, for example on its upward projecting leg which supports the tubular part 92*a*. As the pulling element 31*b* is pulled, the lower gear 86*a* or 86*b* is displaced towards the drive gear 23 in the pulling direction, bringing the gears into engagement. At the same time, the spring 95' is tensioned. When the pulling element 31*b* is released, the spring 95' releases the engagement of the gears 23, 86*a* or 86*b*, so that a free-wheeling motion is established and the return spring 88 can return the pulling cable 53*b* into the cavity or interior 28 in a free-wheeling mode of the actuating mechanism 30*b*.

The concept according to the invention can also be implemented in tiltable furniture parts. This is explained with reference to the following embodiments:

A table top 12 of a piece of furniture 10*c* is for example pivotably mounted on a pivot bearing 29 and is therefore pivotable between a horizontal position (indicated by continuous lines) and an inclined position indicated by a broken line. The pivot bearing 29 is for example mounted at the front of the table top 12. An adjusting gear 20*c* for tilting the furniture part 11 is provided on a furniture base part 13*c* represented by a furniture frame 14*c*. A bevel gear 21*c* operates a spindle 25 screwed through a spindle nut 26 fixed to the furniture frame 14*c*. A drive gear 23 meshes with a driven gear 24 at the head of the spindle 25. The drive gear 23 is operated with a drive shaft 36*c* which laterally projects from the piece of furniture 10*c*. The actuating mechanism 30*a* described above can be coupled to the drive shaft 36*c*, for example attached laterally, thus implementing a pulling process according to the invention for tilting the piece of furniture 10*c*.

In a piece of furniture 10*d* having a similar frame structure as the piece of furniture 10*c*, an actuating mechanism 30*d* fixed to the piece of furniture 10*d* is provided instead of the removable actuating mechanism. The furniture frame 14*d* which forms the furniture base part 13*b* is built similar to the furniture frame 14*c*. Pulling elements 31*d*, 31*d*' are wrapped around wrapping sections 51*d* of drive reels 52*d* and 52*d*'. The pulling elements 31*d*, 31*d*' are guided towards the front approximately into the region of the pivot bearing 29 of the table top 12, where they can be gripped using handle parts 45*d* and 45*d*'. The drive reels 53*d* and 52*d*' are mounted on a drive shaft 98 and act on the drive shaft 98 in opposite directions. The drive shaft 98 is pivotably coupled to the spindle 25 which forms a drive shaft 36*d* of the adjusting gear 20*d*, for example in the manner of a ball joint head with a polygonal driving contour or the like. A cardanic drive or coupling concept between the drive reel assembly with the drive reels 52*d* and 52*d*' and the spindle 25 is also conceivable.

In contrast to the piece of furniture 10*d*, the pieces of furniture 10*e* and 10*f* are each fitted with a single pulling element 31*e* and 31*f* for operating an actuating mechanism 30*e* and 30*f* according to the invention. The table top 12 of the piece of furniture 10*e* is pivotably mounted on a furniture frame 14*e* forming a furniture base part 13*e*. For tilting or for the vertical adjustment of an end section of the table top 12 which is remote from the front table edge, an adjusting gear 20*e* is provided which is rotatable by means of the actuating mechanism 30*e*. The pulling element 31*e* is wrapped around a wrapping section 51*e* of the drive reel 52*e*, which is coupled for rotation with a spindle 25 of the adjusting gear 20*e*, which forms a drive shaft 36*e* of the adjusting gear 20*e*.

In contrast, the pulling element 31*f* of the actuating mechanism 30*f* of the piece of furniture 10*f*, which comprises a furniture frame 14*f* forming a furniture base part 13*f*, is directly wrapped around a wrapping section 51*f* at the upper end of a drive spindle 25*f* forming a drive shaft 36*f*. The pulling element 31*e* is guided on cable guide parts 99*e*, while the pulling element 31*f* is guided on a single cable guide part 99*f*. To direct and guide the pulling elements 31*e*, 31*f*, idler pulleys and guide roller arrangements are further provided, which may for example comprise idler pulleys for the horizontal guidance of the pulling elements 31*e*, 31*f*.

The actuating mechanism 30*f* is further provided with a support or guide roller 7 which guides the pulling element 31*f* in the region of the wrapping section 51*f*.

The pulling elements 31*e*, 31*f* are guided below the table top 12 towards its front. Both pulling elements 31*e*, 31*f* are designed as a type of loop wrapped around the respective wrapping section 51*e*, 51*f*. FIG. 13 illustrates the operating concept.

Each of the two pulling elements 31*e*, 31*f* is held in a neutral position concealed behind an outer contour of the piece of furniture 10*e* or 10*f*, which is indicated by a broken line in FIG. 13, by a return spring 88*f*. The spring 88*f* is located between the two idler pulleys 9 and loads the pulling elements 31*e*, 31*f* at right angles to their pull-out direction, in the present case orthogonally. The spring 88*f* of the return spring means 65*e*, 65*f* is tensioned into a pull-out position A indicated by continuous lines—without rotary actuation of the wrapping sections 51*e*, 51*f*—as the pulling elements 31*e*, 31*f* are pulled out, so that a front loop-like end 8 of the pulling elements 31*e*, 31*f* projects towards the front in front of a contour of the piece of furniture 10*e*, 10*f*. The loop-like end 8 can be gripped by an operator and actuated in a looping motion. In this context, a handle part 45*e* or 45*f* serving as an abutment and permanently joined to the cable-type pulling element 31*e*, 31*f* is useful. If the operator releases the pulling element 31*e*, 31*f*, the return spring means 65*e* or 65*f* pull the respective pulling element 31*e*, 31*f* into the neutral position space R below the table top.

The invention claimed is:

1. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the drive reel has at least one toothing and/or is coupled for rotation with a gear for coupling for rotation with the adjusting gear and/or has a rotary shaft projecting in front of the drive reel and/or a socket for the drive shaft or a coupling part.

2. Piece of furniture according to claim 1, characterised in that that the wrapping section is provided directly on the drive shaft of the adjusting gear or on a drive reel coupled for rotation with the drive shaft.

3. Piece of furniture according to claim 1, characterised in that the pulling element does not operate the adjusting gear as it is pulled into a pull-out position and is available for a rotary actuation of the adjusting gear in the pull-out position.

4. Piece of furniture according to claim 1, characterised in that the pulling element is concealed behind a furniture contour in its neutral position.

5. Piece of furniture according to claim 1, characterised in that the actuating mechanism can be releasably connected to the adjusting gear.

6. Piece of furniture according to claim 5, characterised in that the actuating mechanism can be pushed or screwed onto to the adjusting gear.

7. Piece of furniture according to claim 1, characterised in that the actuating mechanism is held in a coupling position with the adjusting gear by a spring arrangement.

8. Piece of furniture according to claim 1, characterised in that the actuating mechanism is mounted movably between drive positions on the piece of furniture for operating the adjusting gear with opposite directions of rotation.

9. Piece of furniture according to claim 8, characterised in that the drive reel comprising the wrapping section is rotatably mounted on a rotary support, and in that the rotary support is between the two drive positions for coupling the drive reel in opposite directions of rotation rotatably mounted on a rotary bearing, and in that the rotary bearing comprises a tubular part serving as a bearing element, through which the pulling element is guided to the drive reel.

10. Piece of furniture according to claim 1, characterised in that the actuating mechanism is rotatably mounted on a holder of the piece of furniture, so that it can be rotated in a pulling direction in which the pulling element is pulled.

11. Piece of furniture according to claim 1, characterised in that the adjusting gear converts an input rotary actuation into a linear movement.

12. Piece of furniture according to claim 1, characterised in that the adjusting gear comprises two pulling elements acting on the adjusting gear in two opposite directions of rotation.

13. Piece of furniture according to claim 12, characterised in that each of the pulling elements can be brought into a free-wheeling mode by free-wheel devices if the other pulling element is pull-actuated.

14. Piece of furniture according to claim 1, characterised in that the pulling element can be pulled away from the piece of furniture in a pulling motion.

15. Piece of furniture according to claim 1, characterised in that the pulling element can be pulled in front of an outer contour of the piece of furniture.

16. Piece of furniture according to claim 1, characterised in that the pulling element is single-stranded.

17. Piece of furniture according to claim 1, characterised in that the furniture part can be vertically adjusted and/or tilted by means of the adjusting gear.

18. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and a rotary shaft of the actuating mechanism is axially displaceable along its axis, so that, for rotary coupling with the adjusting gear for rotation in opposite directions, it can protrude from opposite end faces of the drive reel, or in that toothing or a gear or a socket for the drive shaft or for a coupling part is provided on both sides of the drive reel.

19. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the actuating mechanism comprises return spring means which are tensioned when the pulling element is pulled into a pull-out position for returning the pulling element into its neutral position.

20. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the return spring means are designed for winding the pulling element onto the wrapping section or onto a take-up reel for the neutral position which is separate from the wrapping section.

21. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and a free-wheel device is provided on the adjusting gear or on the actuating mechanism, which allows a free-wheeling of the pulling element as it is returned into its neutral position without driving the adjusting gear.

22. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the pulling element is withdrawn into a neutral position space in its neutral position.

23. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the actuating mechanism can be connected to the adjusting gear in a first drive position and a second drive position, the actuating mechanism acting on the adjusting gear in opposite directions of rotation in the two drive positions.

24. Piece of furniture comprising a furniture base part and a furniture part movable relative thereto, with an adjusting gear for driving the furniture part and an actuating mechanism for rotary actuation of a drive shaft of the adjusting gear, characterised in that the actuating mechanism for the rotary actuation of the adjusting gear comprises a manually operated cable or belt pulling element which is wrapped around a wrapping section coupled for rotation with the drive shaft at least during an actuation of the actuating mechanism and, when pulled, causes the drive shaft to rotate and the actuating mechanism can be used as a hand tool with a handle section for gripping the tool and comprises a tool holder for holding a drilling or screwing tool.

* * * * *